US006858567B2

(12) United States Patent
Akao

(10) Patent No.: US 6,858,567 B2
(45) Date of Patent: Feb. 22, 2005

(54) LUBRICATING OIL COMPOSITION AND WATCH USING THE SAME

(75) Inventor: Yuji Akao, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 240 days.

(21) Appl. No.: 09/958,415

(22) PCT Filed: Feb. 8, 2001

(86) PCT No.: PCT/JP01/00891

§ 371 (c)(1),
(2), (4) Date: Oct. 9, 2001

(87) PCT Pub. No.: WO01/59043

PCT Pub. Date: Aug. 16, 2001

(65) Prior Publication Data

US 2003/0050197 A1 Mar. 13, 2003

(30) Foreign Application Priority Data

Feb. 9, 2000 (JP) ..... 2000-031319
Jul. 3, 2000 (JP) ..... 2000-200514
Jul. 21, 2000 (JP) ..... 2000-220120

(51) Int. Cl.[7] ..... C10M 105/38; C10M 105/04; C10M 105/18; C10M 161/00

(52) U.S. Cl. ..... 508/280; 508/282; 508/433; 508/467; 508/469; 508/485; 508/563; 508/579

(58) Field of Search ..... 508/280, 282, 508/433, 469, 467, 485, 563, 579

(56) References Cited

U.S. PATENT DOCUMENTS 3,928,218 A * 12/1975 Rowe et al. ..... 508/208
4,302,343 A * 11/1981 Carswell et al. ..... 508/280
4,776,967 A * 10/1988 Ichihashi et al. ..... 508/185
4,853,139 A * 8/1989 Ichihashi ..... 508/591
4,857,220 A * 8/1989 Hashimoto ..... 508/507
5,382,374 A 1/1995 Takemitsu et al.
5,503,760 A * 4/1996 Bongardt et al. ..... 508/495
5,552,071 A * 9/1996 Rudnick et al. ..... 508/581
5,665,683 A 9/1997 Froeschmann
5,773,391 A 6/1998 Lawate et al.
5,888,946 A * 3/1999 Zakarian et al. ..... 508/469
6,034,040 A * 3/2000 Ozbalik et al. ..... 508/469
6,048,825 A * 4/2000 Markson et al. ..... 508/256
6,221,272 B1 * 4/2001 Schnur et al. ..... 252/68
6,296,782 B1 * 10/2001 Schnur et al. ..... 252/68

FOREIGN PATENT DOCUMENTS

EP 0 629 687 A 12/1994
EP 0 952 207 A2 10/1999
WO WO 99/06504 A1 2/1999

* cited by examiner

*Primary Examiner*—Jerry D. Johnson
(74) *Attorney, Agent, or Firm*—Webb Ziesenheim Logsdon Orkin & Hanson, P.C.

(57) ABSTRACT

The first lubricating oil composition of the invention comprises a polyol ester (A) as a base oil, a specific amount of a viscosity index improver (B) and a specific amount of an anti-wear agent (C), and the second lubricating oil composition of the invention comprises a paraffinic hydrocarbon oil (F) having at least 30 carbon atoms and a specific amount of a viscosity index improver (B), so that these compositions exert effects that they enable a life of watch battery to last long, they enable a watch to operate in the temperature range of −30 to 80° C. with one kind of a lubricating oil, and they are free from change of properties over a long period of time. The third lubricating oil composition of the invention comprises an ether oil (G) as a base oil, a specific amount of an anti-wear agent (C) comprising a neutral phosphoric ester and/or a neutral phosphorous ester, and an antioxidant (E), so that this composition is free from change of properties over a long period of time and is favorable as a watch lubricating oil. The watch of the invention is a watch having a movable portion for which at least one composition selected from the above compositions is used.

22 Claims, No Drawings

LUBRICATING OIL COMPOSITION AND WATCH USING THE SAME

BACKGROUND OF THE INVENTION

1. Field of the Invention

The present invention relates to lubricating oil compositions and watches using the same. More particularly, the invention relates to lubricating oil compositions favorably used as lubricating oils particularly for movable portions including slide and rotation portions of watches, and watches using the lubricating oil compositions.

2. Description of the Prior Art

Watches are broadly divided into mechanical watches and electronic watches. The mechanical watches are those which are operated by the use of a spiral spring as the driving source, while the electronic watches are those which are operated by the use of electric power. In both electronic watches and mechanical watches, tram wheel portions wherein gears to drive the hour hand, the minute hand and the second hand gather and a movable portion such as a lever are combined to display the time.

In the field of watch manufacture, only the mechanical watches were invented but any electronic watch was not invented in the initial stage. In order to make smooth operation of mechanical watches, lubricating oil is poured into the movable portion of the rotary device. In mechanical watches, a force from the spiral spring is always applied to the train wheel portions, so that a precious stone (ruby) is provided as a tenon receiver of the train wheel portions to reduce frictional wear, and the rotary gear is made of a relatively highly wear-resistant stable metal such as iron.

After that, with the spread of batteries, electronic watches have been put on the market, and recently, the present applicant has proposed watches which are operated for a certain period of time by the use of primary battery and watches which are continuously operated by the use of a combination of a light power-generation element or a thermal power-generation element and a rechargeable battery even if the battery is not changed. Further, uses of watches have been widened, and watches for sky diving or scuba diving have become commercially available. In the sales of the watches, not only finished articles of watches but also modules thereof have been made available for purchase.

Thus, because of the extension of uses or sales manner and transfiguration of modes of watches, watch modules are desired to have moisture resistance, heat resistance, low-temperature resistance, thermal impact resistance and long life. As materials to manufacture watches, brass has excellent processability and then plastic members have been used, so that corrosiveness of lubricating oils to metals or plastics needs to be reduced.

The present applicant has used, as a lubricating oil for watch, for example, Synt-Lube available from MOEBIUS Co. This lubricating oil is a mixture of synthetic hydrocarbons with ether and alcohol groups. The base oil of the lubricating oil is a mixture of alkyl-aryloxydibutylene glycols, and to the base oil, 1.6% of an alkylphenoxy acid, less than 1% of 2,6-di-tert-butyl-4-methylphenol, C3–C14 Zn-dialkyl dithiophosphate, etc. are added as additives (Synt-Lube MSDS available from MOEBIUS Co., transcribed from catalogue).

In the use of this currently used lubricating oil (Synt-Lube available from MOEBIUS Co.), operational failure of watch such as stoppage occasionally takes place. The present applicant owns service stations to collect and repair watches and has investigated the operational failure of these watches. As a result, more than 10 years ago, the present applicant found problems such as the lubricating oil changing into a gel and corrosion of the plastic members or metals.

The above-mentioned lubricating oil is a medium-viscosity lubricating oil having a kinematic viscosity (JIS K2283-1979) of 27 cSt at 50° C. and 2600 cSt at −20° C., and there is a problem that if the lubricating oil is used for all the train wheel portions, a phenomenon of spreading-out of the lubricating oil occurs by viscosity decrease at a high temperature of 80° C.

To solve the above problem, the present applicant uses a lubricating oil of high viscosity (kinematic viscosity (JIS K2283-1979): 45 cSt at 50° C., 13500 cSt at −20° C.) for only the place of high driving power and avoids use of the lubricating oil of high viscosity for the place of low driving power because the whole viscosity is increased to raise power consumption.

On this account, there is brought about a problem that spreading out of the lubricating oil takes place at a high temperature of 80° C. depending upon the gears of the train wheel portions. In the case of a low temperature of −10° C., there is another problem in that driving becomes infeasible because of viscosity increase of the lubricating oil.

Therefore, the present applicant uses a lubricating oil of low viscosity (kinematic viscosity (JIS K2283-1979): 16 cSt at 50° C., 840 cSt at −20° C.) for only the place of low driving power (rotor section) to avoid the problem given at the low Temperature of −10° C. In this case, however, the viscosity is strikingly lowered at a high temperature of 80° C., resulting in a problem of spreading-out of the lubricating oil. In addition, the watches have a problem at low temperatures, that is, operation failure takes place when the temperature becomes lower than −10° C.

Further, there are many kinds of lubricating oils, namely, three kinds of medium-viscosity, high-viscosity and low-viscosity lubricating oils, and they must be used properly in the manufacture or repair of the watches. As a result, there is a possibility of wrong use of the lubricating oils.

In the use of the currently used lubricating oils, as described above, there are various problems such as a problem of spreading-out of the lubricating oil at high temperatures, a problem of feeding oil to the place of low driving power at low temperatures, a problem of gelation, a problem of change of properties such as corrosion of plastic members or metals and a problem of too many kinds of lubricating oils used.

The present invention has been made to solve such problems associated with the prior art as described above, and it is an object of the invention to provide a lubricating oil composition which enables a watch to operate in the temperature range of −30 to 80° C. with one kind of a lubricating oil, is free from change of properties over a long period of time, enables a life of watch battery to last long and is favorable as a watch lubricating oil, and to provide a watch using the composition.

It is another object of the invention to provide a lubricating oil composition which is free from change of properties over a long period of time, enables a life of watch battery to last long and is favorable as a watch lubricating oil, and to provide a watch using the composition.

SUMMARY OF THE INVENTION

The first lubricating oil composition according to the invention comprises a base oil comprising a polyol ester (A), a viscosity index improver (B) in an amount of 0.1 to 20% by weight and an anti-wear agent (C) in an amount of 0.1 to 8% by weight.

The first lubricating oil composition desirably has a kinematic viscosity (JIS K2283-1979, the same shall apply hereinafter) of not more than 1500 cSt and not less than 13 cSt at −30 to 80° C., a weight change of not more than 1.62% by weight after allowed to stand at 90° C. and a total acid number of not more than 0.2 mgKOH/g.

As the viscosity index improver (B), at least one compound selected from polyacrylate, polymethacrylate, polyisobutylene, polyalkylstyrene, polyester, isobutylene fumarate, styrene maleate ester, vinyl acetate fumarate ester and an α-olefin copolymer is generally employed.

As the anti-wear agent (C), a neutral phosphoric ester and/or a neutral phosphorous ester is generally employed.

The first lubricating oil composition of the invention may further contain a metal deactivator (D). The metal deactivator (D) is preferably benzotriazole or a derivative thereof.

The first lubricating oil composition of the invention may further contain an antioxidant (E).

The second lubricating oil composition according to the invention comprises a base oil comprising a paraffinic hydrocarbon oil (F) having at least 30 carbon atoms and a viscosity index improver (B) in an amount of 0.1 to 15% by weight.

The second lubricating oil composition of the invention preferably has a kinematic viscosity of not more than 1500 cSt and not less than 13 cSt at −30 to 80° C. This lubricating oil composition particularly preferably has a kinematic viscosity of not more than 1500 cSt and not less than 13 cSt at −30 to 80° C. and a weight change of not more than 10% by weight after allowed to stand at 90° C.

The paraffinic hydrocarbon oil (F) has no polarity and thereby is incompatible with other many materials, and besides this oil is chemically inert and thereby hardly changed in properties. Therefore, the paraffinic hydrocarbon oil (F) is favorable as a base oil of a lubricating oil for watches having plastic parts. In this case, it is preferable to select a compound having no polar group as an additive, particularly, as the viscosity index improver (B). When a compound having a polar group, such as polyacrylate or polymethacrylate, is used as the viscosity index improver (B), the second lubricating oil composition preferably has a total acid number of not more than 0.2 mgKOH/g. By the use of the second lubricating oil composition having such a total acid number as a watch lubricating oil, the watches can be operated over a long period of time.

As the viscosity index improver (B), at least one compound selected from polyacrylate, polymethacrylate, polyisobutylene, polyalkylstyrene, polyester, isobutylene fumarate, styrene maleate ester, vinyl acetate fumarate ester and an α-olefin copolymer is generally employed. Of these, most preferable is an alkyl compound having no polar group such as polyisobutylene or an ethylene/α-olefin copolymer (α-olefin copolymer) because it is incompatible with plastics, chemically inert and hardly changed in the properties. Next preferable is an aromatic alkyl compound, and next preferable is an aromatic compound.

The second lubricating oil composition of the invention may further contain an anti-wear agent (C) in an amount of 0.1 to 8% by weight.

As the anti-wear agent (C), a neutral phosphoric ester and/or a neutral phosphorous ester is generally employed.

The second lubricating oil composition of the invention may further contain a metal deactivator (D). As the metal deactivator (D), benzotriazole or a derivative thereof is preferable.

The second lubricating oil composition of the invention may further contain an antioxidant (E).

The third lubricating oil composition according to the invention comprises a base oil comprising an ether oil (G), an anti-wear agent (C) and an antioxidant (E), wherein the anti-wear agent (C) is a neutral phosphoric ester and/or a neutral phosphorous ester and the content of the anti-wear agent (C) is in the range of 0.1 to 8% by weight.

The ether oil (G) preferably used is an ether oil represented by the following formula:

$$R^1—(—O—R^2—)_n—R^1$$

wherein each $R^1$ is independently an alkyl group of 1 to 18 carbon atoms or a monovalent aromatic hydrocarbon group of 6 to 18 carbon atoms, $R^2$ is an alkylene group of 1 to 18 carbon atoms or a divalent aromatic hydrocarbon group of 6 to 18 carbon atoms, and n is an integer of 1 to 5.

The third lubricating oil composition of the invention desirably has a total acid number of not more than 0.2 mgKOH/g.

In the first to the third lubricating oil compositions of the invention, the antioxidant (E) is preferably a phenol type antioxidant and/or an amine type antioxidant.

The amine type antioxidant is preferably a diphenylamine derivative.

The phenol type antioxidant is preferably at least one compound selected from 2,6-di-t-butyl-p-cresol, 2,4,6-tri-t-butylphenol and 4,4'-methylenebis(2,6-di-t-butyl)phenol.

The first, the second and the third lubricating oil compositions of the invention are favorable as lubricating oils used for movable portions of watches.

The watch according to the invention is a watch having a movable portion for which at least one lubricating oil composition selected from the first, the second and the third lubricating oil compositions of the invention is used.

DETAILED DESCRIPTION OF THE INVENTION

The lubricating oil composition according to the invention and the watch using the composition are described in detail hereinafter.

The lubricating oil composition of the invention needs to have a kinematic viscosity of not less than 13 cSt and not more than 1500 cSt in the operating temperature range.

The operating temperature of watch is usually from −10° C. to 80° C., so that the kinematic viscosity should be not more than 1500 cSt at −10° C. and not less than 13 cSt at 80° C. However, the present time at which use application has been extended, the kinematic viscosity is preferably in the above range in the temperature range of −30 to 80° C. A synthetic oil for use as a watch lubricating oil usually has such a kinematic viscosity that the surface tension may become approx. 20 to 40 mN/m. If the watch lubricating oil having this surface tension is fed to the train wheel portions and if the kinematic viscosity becomes not more than 13 cSt, the lubricating oil spreads out from the movable portion, and the performance of the watch cannot be maintained. To the contrary, if the kinematic viscosity becomes not less than 1500 cSt, the working resistance to movable portions becomes large and the watch does not operate properly.

A watch must be lubricated for a long period of time with a certain amount of a lubricating oil, so that the evaporation loss of the lubricating oil should be small. When 230 g of a lubricating oil is placed in a container having a diameter of 6 cm and a depth of 10 cm and allowed to stand for 1000 hours at 90° C. in an open state, the evaporation loss of the lubricating oil is required to be not more than 10% by weight in order to operate the watch in the operating temperature range of −10 to 80° C. When the evaporation loss is not more than 10% by weight, the operation can be guaranteed even if a watch module is sold alone.

A finished article of watch is manufactured by combining an exterior part and a module, and not only the finished article but also the module alone is sold, so that the watch lubricating oil should be stable not only to temperature but also to humidity.

Examples of the watch materials include brass containing copper or zinc, nickel, iron, and plastics such as polyoxymethylene (POM), polycarbonate (PC), polystyrene (PS) and polyphenylene ether (PPE). When the watch lubricating oil is brought into contact with these watch materials, the lubricating oil must not bring about corrosion of the materials, swelling thereof and occurrence of sludge.

Examples of synthetic oils satisfying the above requirements include an ester oil, a paraffinic hydrocarbon oil (PAO), a silicone oil, and a currently used ether oil or glycol oil.

In the use of the currently used ether oil or glycol oil, there is a problem that the moisture resistance is lowered because these oils have moisture absorption properties. The present applicant has earnestly studied lubricating oil compositions containing an ether oil as a base oil and has found that lowering of the moisture resistance can be prevented by allowing a lubricating oil composition to have specific formulation like the third lubricating oil composition of the invention.

In the use of the silicone oil, there is a problem that its lubricity is low and its dissolving power against the additives is so low that improvement of lubricity cannot be obtained. In addition, such a lubricating oil spreads out on the metal surface.

The paraffinic hydrocarbon oil (PAO) has a low dissolving power and rarely corrodes plastics Therefore, this oil is advantageous especially when many plastic parts are used. The materials themselves of the plastic parts have lubricity, so that even if the base oil is inferior to the ester oil in the lubricity, there is no difference in the lubricity. The paraffinic hydrocarbon oil, however, is unsuitable as a watch lubricating oil because of its bad evaporation properties. The present applicant has earnestly studied lubricating oil compositions containing a paraffinic hydrocarbon oil as a base oil and has found that the evaporation properties can be improved by allowing a lubricating oil composition to have specific formulation like the second lubricating oil composition of the invention.

The ester oil itself has lubricity when used as a base oil and has such a high dissolving power that occurrence of sludge can be inhibited, so that the amounts of the additives can be decreased. By the use of the ester oil, further, the resulting lubricating oil having satisfactory low-temperature properties can be used at high temperatures, and hence the amount of the viscosity index improver can be increased. In the use of the ester oil, however, the materials of the plastic parts are specifically restricted because the ester oil has a high dissolving power. The present applicant has earnestly studied lubricating oil compositions containing an ester oil as a base oil and has found that the materials of the plastic parts are not restricted by allowing a lubricating oil composition to have specific formulation like the first lubricating oil composition of the invention.

First Lubricating Oil Composition

The first lubricating oil composition of the invention comprises a polyol ester (A) as a base oil, a viscosity index improver (B), an anti-wear agent (C), and optionally, a metal deactivator (D) and an antioxidant(E).

Polyol Ester (A)

The polyol ester (A) for use as a base oil in the first lubricating oil composition is specifically an ester having a structure obtained by allowing a polyol having two or more hydroxyl groups in one molecule to react with one or plural kinds of monobasic acids or acid chlorides.

Examples of the polyols include neopentyl glycol, trimethylolpropane, pentaerythritol and dipentaerythritol.

Examples of the monobasic acids include:

saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid and palmitic acid;

unsaturated aliphatic carboxylic acids, such as stearic acid, acrylic acid, propionic acid, crotonic acid and oleic acid; and cyclic carboxylic acids, such as benzoic acid, toluic acid, napthoic acid, cinnamic acid, cyclohexanecarboxylic acid, nicotinic acid, isonicotinic acid, 2-furoic acid, 1-pyrrolecarboxylic acid, monoethyl malonate and ethyl hydorgenphthalate.

Examples of the acid chlorides include chlorides of the above-mentioned monobasic acids.

Examples of the reaction products include a neopentyl glycol caprylate caprate mixed ester, a trimethylolpropane valerate heptanoate mixed ester, a trimethylolpropane decanoate octanoate mixed ester, trimethylolpropane nananoate, and a pentaerythritol heptanoate caprate mixed ester.

As the polyol ester (A) for use in the invention, a polyol ester having not more than 3 hydroxyl groups is preferable, and a perfect ester having no hydroxyl group is particularly preferable.

The kinematic viscosity of the polyol ester (A) is preferably not more than 1500 cSt at −30° C.

Viscosity Index Improver (B)

The viscosity index improver (B) for use in the first lubricating oil composition of the invention is usually one polymer selected from polyacrylate, polymethacrylate, polyisobutylene, polyalkylstyrene, polyester, isobutylene fumarate, styrene maleate ester, vinyl acetate fumarate ester and an α-olefin copolymer, or at least one copolymer selected from copolymers such as a polybutadiene/styrene copolymer, a polymethyl methacrylate/vinylpyrrolidone copolymer and an ethylene/alkyl acrylate copolymer.

Examples of the polyacrylates and polymethacrylates employable in the invention include polymers of acrylic acid or methacrylic acid and polymers of alkyl esters of 1 to 10 carbon atoms. Of these, polymethacrylate obtained by polymerization of methyl methacrylate is preferable.

As the above viscosity index improvers, compounds hitherto known are employable.

Examples of the polyalkylstyrenes include polymers of monoalkylstyrenes having substituents of 1 to 18 carbon atoms, such as poly-α-methylstyrene, poly-β-methylstyrene, poly-α-ethylstyrene and poly-β-ethylstyrene.

Examples of the polyesters include polyesters obtained from polyhydric alcohols having 1 to 10 carbon atoms, such as ethylene glycol, propylene glycol, neopentyl glycol and dipentaerythritol, and polybasic acids, such as oxalic acid, malonic acid, succinic acid, glutaric acid, adipic acid, fumaric acid and phthalic acid.

Examples of the α-olefin copolymers include an ethylene/propylene copolymer consisting of recurring units derived from ethylene and recurring units derived from isopropylene, and reaction products obtained by copolymerization of α-olefins of 2 to 18 carbon atoms such as ethylene, propylene, butylene and butadiene.

These compounds can be used singly or in combination of two or more kinds.

In the present invention, the viscosity index improver (B) is used in an amount of 0.1 to 20% by weight, preferably 0.1 to 15% by weight, more preferably 0.1 to 10% by weight, based on 100% by weight of the lubricating oil composition.

When the viscosity index improver (B) is used in the above amount, a watch using the composition can be operated properly

Anti-wear Agent (C)

The anti-wear agent (C) for use in the first lubricating oil composition of the invention is usually a neutral phosphoric ester and/or a neutral phosphorous ester.

Examples of the neutral phosphoric esters include tricresyl phosphate, trixylenyl phosphate, trioctyl phosphate, trimethylolpropane phosphate, triphenyl phosphate, tris (nonylphenyl) phosphate, triethyl phosphate, tris(tridecyl) phosphate, tetraphenyidipropylene glycol diphosphate, tetraphenyltetra(tridecyl)pentaerythritol tetraphosphate, tetra(tridecyl)-4,4'-isopropylidenediphenyl phosphate, bis (tridecyl)pentaerythritol diphosphate, bis(nonylphenyl) pentaerythritol diphosphate, tristearyl phosphate, distearylpentaerythritol diphosphate, tris(2,4-di-t-butylphenyl) phosphate, and a hydrogenated bisphenol A/pentaerythritol phosphate polymer.

Examples of the neutral phosphorous esters include trioleyl phosphite, trioctyl phosphite, trimethylolpropane phosphite, triphenyl phosphite, tris(nonylphenyl) phosphite, triethyl phosphite, tris(tridecyl) phosphite, tetraphenyldipropylene glycol diphosphite, tetraphenyltetra(tridecyl) pentaerythritol tetraphosphite, tetra(tridecyl)-4,4'-isopropylidenediphenyl phosphite, bis(tridecyl) pentaerythritol diphosphite, bis(nonylphenyl)pentaerythritol diphosphite, tristearyl phosphite, distearylpentaerythritol diphosphite, tris(2,4-di-t-butylphenyl) phosphite, and a hydrogenated bisphenol A/pentaerythritol phosphite polymer.

These compounds can be used singly or in combination of two or more kinds.

In the present invention, the anti-wear agent (C) is used in an amount of 0.1 to 8% by weight, preferably 0.1 to 5% by weight, more preferably 0.5 to 1.5% by weight, based on 100% by weight of the lubricating oil composition. When the anti-wear agent (C) is used in the above amount, a watch using the composition can be operated properly without frictional wear.

Metal Deactivator (D)

The metal deactivator (D) that is optionally used in the first lubricating oil composition of the invention is preferably benzotriazole or its derivative.

Examples of the benzotriazole derivatives include 2-(2'-hydroxy-5'-methylphenyl)benzotriazole, 2-(2'-hydroxy-3',5'-bis(α,α-dimethylbenzyl)phenyl)benzotriazole, 2-(2'-hydroxy-3',5'-di-t-butylphenyl)berzotriazole, and compounds of structures represented by the following formulas wherein R, R' and R" are each an alkyl group of 1 to 18 carbon atoms, such as 1-(N,N-bis(2-ethylhexyl) aminomethyl)benzotriazole.

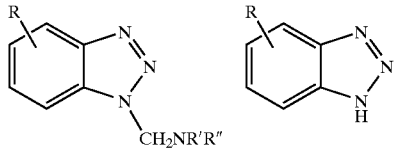

These compounds can be used singly or in combination of two or more kinds.

In the present invention, the metal deactivator (D) is used in an amount of usually 0.01 to 3% by weight, preferably 0.02 to 1% by weight, more preferably 0.03 to 0.06% by weight, based on 100% by weight of the lubricating oil composition. When the metal deactivator (D) is used in the above amount together with the viscosity index improver (B) and the anti-wear agent (C), corrosion of metals such as copper can be prevented.

When the first lubricating oil composition of the invention is used for a watch using a metal part, e.g., Watch Movement™ (No. 2035, available from Citizen Watch Co., Ltd., train wheel portions: made of metal (mainly made of brass and iron)), not only the oil base of the lubricating oil but also the metal part must not be changed in the properties. In this case, it is preferable to add the metal deactivator (D).

Antioxidant (E)

The antioxidant (E) that is optionally used in the first lubricating oil composition of the invention is usually a phenol type antioxidant and/or an amine type antioxidant.

The amine type antioxidant is preferably a diphenylamine derivative.

The phenol type antioxidant is preferably at least one compound selected from 2,6-di-t-butyl-p-cresol, 2,4,6-tri-t-butylphenol and 4,4'-methylenebis(2,6-di-t-butyl)phenol.

The antioxidant (E) can be used singly or in combination of two or more kinds.

In the present invention, the antioxidant (E) is used in an amount of usually 0.01 to 3% by weight, preferably 0.01 to 2% by weight, more preferably 0.03 to 1.20% by weight, based on 100% by weight of the lubricating oil composition. When the antioxidant (E) is used in the above amount, the lubricating oil composition can be prevented from change of properties over a long period of time.

In a watch module that is used for a long period of time, a lubricating oil composition used therefor should be prevented from oxidation so as not to be changed in the properties over a long period of time. In order that the first lubricating oil composition of the invention may be stabilized over a long period of time without being oxidized, it is preferable to add the antioxidant (E).

First Lubricating Oil Composition

The first lubricating oil composition of the invention is desired to usually have a kinematic viscosity of not more than 1500 cSt and not less than 13 cSt at −30 to 80° C., a weight change of not more than 1.62% by weight after allowed to stand at 90° C. and a total acid number of not more than 0.2 mgKOH/g.

When the weight change, namely, evaporation loss, as measured after the composition is allowed to stand at 90° C. is not more than 1.62% by weight, the composition exhibits excellent operation stability at high temperatures. When the total acid number is not more than 0.2 mgKOH/g, there is no change of the consumption electric current, and viscosity increase and corrosion of watch members can be prevented, so that such a lubricating oil composition is favorable as a watch lubricating oil.

The first lubricating oil composition of the invention is particularly preferable as a lubricating oil for a watch having a metal part.

Second Lubricating Oil Composition

The second lubricating oil composition of the invention comprises a paraffinic hydrocarbon oil (F) as a base oil, a viscosity index improver (B), and optionally, an anti-wear agent (C), a metal deactivator (D) and an antioxidant (E).

Paraffinic Hydrocarbon Oil (F)

The paraffinic hydrocarbon oil (F) for use as a base oil in the second lubricating oil composition of the invention comprises an α-olefin polymer of 30 or more carbon atoms, preferably 30 to 50 carbon atoms.

The α-olefin polymer of 30 or more carbon atoms is a polymer or copolymer, which comprises one or more olefins selected from ethylene and α-olefins of 3 to 18 carbon atoms and has 30 or more carbon atoms in total. Specifically, there can be mentioned a trimer of 1-decene, a trimer of 1-undecene, a trimer of 1-dodecene, a trimer of 1-tridecene, a trimer of 1-tetradecene, a copolymer of 1-hexene and 1-pentene, and the like.

The paraffinic hydrocarbon oil (F) for use in the invention is preferably a paraffinic hydrocarbon oil having 30 or more carbon atoms and a kinematic viscosity of not more than 1500 cSt at −30° C.

Viscosity Index Improver (B)

The viscosity index improver (B) for use in the second lubricating oil composition of the invention is usually at least one compound selected from polyacrylate, polymethacrylate, polyisobutylene, polyalkylstyrene, polyester, isobutylene fumarate, styrene maleate ester, vinyl acetate fumarate ester and an α-olefin copolymer. Of these, polyisobutylene is preferable.

Examples of the polyalkylstyrenes, the polyesters and the α-olefin copolymers include the same compounds as enumerated above in the paragraph of the viscosity index improver (B) for use in the first lubricating oil composition of the invention.

The viscosity index improver (B) can be used singly or in combination of two or more kinds.

In the present invention, the viscosity index improver (B) is used in an amount of 0.1 to 15% by weight, preferably 0.1 to 15% by weight, more preferably 0.1 to 10% by weight, based on 100% by weight of the lubricating oil composition. When the viscosity index improver (B) is used in the above amount, viscosity change of the paraffinic hydrocarbon oil (F) due to the temperature change can be reduced and a watch using the composition can be operated properly.

Anti-wear Agent (C)

The anti-wear agent (C) that is optionally used in the second lubricating oil composition of the invention is usually a neutral phosphoric ester and/or a neutral phosphorous ester.

Examples of the neutral phosphoric esters and the neutral phosphorous esters include the same compounds as enumerated above in the paragraph of the anti-wear agent (C) for use in the first lubricating oil composition of the invention.

The anti-wear agent (C) can be used singly or in combination of two or more kinds.

In the present invention, the anti-wear agent (C) is used in an amount of 0.1 to 8% by weight, preferably 0.1 to 5% by weight, more preferably 0.5 to 1.5% by weight, based on 100% by weight of the lubricating oil composition. When the anti-wear agent (C) is used in the above amount, wear resistance can be improved.

When the second lubricating oil composition of the invention is used for a watch using a metal part in combination with a plastic part, e.g., Watch Movement™ (No. 7680, No. 1030, available from Citizen Watch Co., Ltd., train wheel portions: plastic and metal gears are used), it is preferable to add the anti-wear agent (C) so that the metal part should not be worn.

Metal Deactivator (D)

The metal deactivator (D) that is optionally used in the second lubricating oil composition of the invention is preferably benzotriazole or its derivative.

Examples of the benzotriazole derivatives include the same compounds as enumerated above in the paragraph of the metal deactivator (D) for use in the first lubricating oil composition of the invention.

The metal activator (D) can be used singly or in combination of two or more kinds.

In the present invention, the metal deactivator (D) is used in an amount of preferably 0.01 to 3% by weight, more preferably 0.02 to 1% by weight, still more preferably 0.03 to 0.06% by weight, based on 100% by weight of the lubricating oil composition. When the metal deactivator (D) is used in the above amount, corrosion of metals such as copper can be prevented.

When the second lubricating oil composition of the invention is used for a watch using a metal part in combination with a plastic part, e.g., the aforesaid Watch Movement™ (No. 7680, No. 1030), not only the oil base of the lubricating oil but also the metal part must not be changed in the properties. In this case, it is preferable to add the metal deactivator (D).

Antioxidant (E)

The antioxidant (E) that is optionally used in the second lubricating oil composition of the invention is usually a phenol type antioxidant and/or an amine type antioxidant.

Examples of the amine type antioxidants and the phenol type antioxidants include the same compounds as enumerated above in the paragraph of the antioxidant (E) optionally used in the first lubricating oil composition of the invention.

The antioxidant (E) can be used singly or in combination of two or more kinds.

In the present invention, the antioxidant (E) is used in an amount of preferably 0.1 to 3% by weight, more preferably 0.01 to 2% by weight, still more preferably 0.03 to 1.20% by weight, based on 100% by weight of the lubricating oil composition. When the antioxidant (E) is used in the above amount, the lubricating oil composition can be prevented from change of properties over a long period of time.

In a watch module that is used for a long period of time, a lubricating oil composition used therefor should be prevented from oxidation so as not to be changed in the properties over a long period of time. Therefore, in order that the second lubricating oil composition of the invention may be stabilized over a long period of time without being oxidized, it is preferable to add the antioxidant (E).

Second Lubricating Oil Composition

The second lubricating oil composition of the invention is desired to have a kinematic viscosity of not more than 1500 cSt and not less than 13 cSt at −30 to 80° C. When the lubricating oil composition having a kinematic viscosity of this range is used for a watch having train wheel portions made of plastic, e.g., Watch Movement™ (No-7630, available from Citizen Watch Co., Ltd.), the watch can be operated properly. The second lubricating oil composition of the invention particularly preferably has a kinematic viscosity of not more than 1500 cSt and not less than 13 cSt at −30 to 80° C. and a weight change of not more than 10% by weight after allowed to stand at 90° C.

When the lubricating oil composition having a kinematic viscosity of the above range and a weight change of the above range is used, the watch can be operated properly in the temperature range of −30 to 80° C.

The second lubricating oil composition of the invention containing the anti-wear agent (C) and the metal deactivator (D) is favorable as a lubricating oil for a watch using a metal part in combination with a plastic part (e.g., gear).

Third Lubricating Oil Composition

The third lubricating oil composition of the invention comprises an ether oil (G) as a base oil, an anti-wear agent (C) and an antioxidant (E).

Ether Oil (G)

The ether oil (G) for use in the third lubricating oil composition of the invention is preferably an ether oil represented by the following formula:

$$R^1—(—O—R^2—)_n—R^1$$

wherein each $R^1$ is independently an alkyl group of 1 to 18 carbon atoms or a monovalent aromatic hydrocarbon group of 6 to 18 carbon atoms, $R^2$ is an alkylene group of 1 to 18 carbon atoms or a divalent aromatic hydrocarbon group of 6 to 18 carbon atoms, and n is 0 or an integer of 1 to 5.

Examples of the alkyl groups of 1 to 18 carbon atoms indicated by R include methyl, ethyl, propyl, isopropyl, n-butyl, isobutyl, sec-butyl, t-butyl, n-pentyl, isopentyl, t-pentyl, neopentyl, hexyl, isohexyl, heptyl, octyl, nonyl, decyl, undecyl, dodecyl, tridecy, tetradecyl, pentadecyl, hexadecyl, heptadecyl and octadecyl.

Examples of the monovalent aromatic hydrocarbon groups of 6 to 18 carbon atoms indicated by $R^1$ include phenyl, tolyl, xylyl, benzyl, phenethyl, 1-phenylethyl and 1-methyl-1-phenylethyl.

Examples of the alkylene groups of 1 to 18 carbon atoms indicated by $R^2$ include methylene, ethylene, propylene and butylene.

Examples of the divalent aromatic hydrocarbon groups of 6 to 18 carbon atoms indicated by $R^2$ include phenylene and 1,2-naphthylene.

The ether oil represented by the above formula has no hydroxyl group at the molecular end, and hence this oil is excellent in the moisture absorption resistance.

Anti-wear Agent (C)

The anti-wear agent (C) for use in the third lubricating oil composition of the invention is usually a neutral phosphoric ester and/or a neutral phosphorous ester.

Examples of the neutral phosphoric esters and the neutral phosphorous esters include the same compounds as enumerated above in the paragraph of the anti-wear agent (C) for use in the first lubricating oil composition of the invention.

The anti-wear agent (C) can be used singly or in combination of two or more kinds.

In the present invention, the anti-wear agent (C) is used in an amount of preferably 0.1 to 8% by weight, more preferably 0.1 to 5% by weight, still more preferably 0.5 to 1.5% by weight, based on 100% by weight of the lubricating oil composition. When the anti-wear agent (C) is used in the above amount, wear resistance can be improved.

When the third lubricating oil composition of the invention is used for a watch using a metal part in combination with a plastic part, e.g., Watch Movement™ (No. 7680, No. 1030, available from Citizen Watch Co., Ltd., train wheel portions: plastic and metal gears are used), it is preferable to add the anti-wear agent (C) so that the metal part should not be worn.

Antioxidant (E)

The antioxidant (E) for use in the third lubricating oil composition of the invention is usually a phenol type antioxidant and/or an amine type antioxidant.

Examples of the amine type antioxidants and the phenol type antioxidants include the same compounds as enumerated above in the paragraph of the antioxidant (E) optionally used in the first lubricating oil composition of the invention.

The antioxidant (E) can be used singly or in combination of two or more kinds.

In the present invention, the antioxidant (E) is used in an amount of preferably 0.01 to 2% by weight, more preferably 0.03 to 1.20% by weight, based on 100% by weight of the lubricating oil composition. When the antioxidant (E) is used in the above amount, the lubricating oil composition can be prevented from change of properties over a long period of time.

Third Lubricating Oil Composition

The third lubricating oil composition of the invention is desired to have a total acid number of not more than 0.2 mgKOH/g. When the lubricating oil composition having a total acid number of not more than 0.2 mgKOH/g is used, there is no change of the consumption electric current, and viscosity increase of the lubricating oil composition and corrosion of watch members can be prevented.

The third lubricating oil composition of the invention is favorable as a lubricating oil for a watch having train wheel portions consisting of plastic parts or a watch having train wheel portions consisting of metal parts. This lubricating oil composition is particularly favorable as a lubricating oil for a watch having train wheel portions consisting of metal parts.

Watch

The watch of the invention is a watch wherein at least one lubricating oil composition selected from the first, the second and the third lubricating oil compositions of the invention is used for the movable portion.

Embodiments of the watch of the invention are, for example, the following watches (1) to (7):

(1) watch using the first lubricating oil composition of the invention for all movable portions, (2) watch using the second lubricating oil composition of the invention for all movable portions, (3) watch using the third lubricating oil composition of the invention for all movable portions, (4) watch using three kinds of the first lubricating oil compositions of the invention which are different in the formulation, kinematic viscosity or the like for three movable portions, respectively, (5) watch using three kinds of the second lubricating oil compositions of the invention which are different in the formulation, kinematic viscosity or the like for three movable portions, respectively, (6) watch using three kinds of the third lubricating oil compositions of the invention which are different in the formulation, kinematic viscosity or the like for three movable portions, respectively, and (7) watch using three kinds of the first, the second and the third lubricating oil compositions of the invention for three movable portions, respectively.

There is no specific limitation on the watches, and any of mechanical watches and electronic watches are available as far as they need a lubricating oil.

The first lubricating oil composition of the invention comprises the polyol ester (A) as a base oil, a specific amount of the viscosity index improver (B) and a specific amount of the anti-wear agent (C), so that this composition exerts effects that the composition enables a life of watch battery to last long, enables a watch to operate in the temperature range of −30 to 80° C. with one kind of a lubricating oil, and is free from change of properties over a long period of time.

Especially when the first lubricating oil composition of the invention which comprises the polyol ester (A) having a kinematic viscosity of not more than 1500 cSt at −30° C., the viscosity index improver (B), the anti-wear agent (C) and the metal deactivator (D) and which has a kinematic viscosity of not more than 1500 cSt and not less than 13 cSt at −30 to 80° C., a weight change of not more than 1.62% by weight after allowed to stand at 90° C. and a total acid number of not more than 0.2 mgKOH/g is used as a watch lubricating oil, there is an effect that a watch which is operated in the temperature range of only −10 to 80° C. by the use of three kinds of currently used lubricating oils having different viscosities can be stably operated in the temperature range of −30 to 80° C. over a long period of time by the use of only one kind of the lubricating oil composition.

When the first lubricating oil composition of the invention is used for a movable portion of a watch, duration of the watch is greatly extended from 10 years (duration of currently used watch) to 20 years. On this account, watches requiring maintenance at intervals of 10 years, such as sunlight power-generation watch (trade name: Ecodrive, available from Citizen Watch Co., Ltd.), thermal power-generation watch (trade name: Ecothermo, available from Citizen Watch Co., Ltd.) and wristwatch guaranteed throughout the lifetime, can be operated over 20 years with high reliability, and hence they can be made maintenance-free. In addition, by virtue of no corrosion of watch members or no viscosity increase of the lubricating oil composition, the battery life is extended, and as a result, the number of watches withdrawn to a service station because of operation failure is markedly decreased.

The second lubricating oil composition of the invention comprises the paraffinic hydrocarbon oil (F) of 30 or more carbon atoms and a specific amount of the viscosity index improver (B), so that this composition exerts effects that the composition enables a life of watch battery to last long, enables a watch to operate in the temperature range of −30 to 80° C. with one kind of a lubricating oil, and is free from change of properties over a long period of time.

Especially when the second lubricating oil composition of the invention which comprises the paraffinic hydrocarbon oil (F) of 30 or more carbon atoms having a kinematic viscosity of not more than 1500 cSt at −30° C., the viscosity index improver (B), the anti-wear agent (C) and the metal deactivator (D) and which has a kinematic viscosity of not more than 1500 cSt and not less than 13 cSt at −30 to 80° C., a weight change of not more than 1.62% by weight after allowed to stand at 90° C. and a total acid number of not more than 0.2 mgKOH/g is used as a watch lubricating oil, there is an effect that a watch which is operated in the temperature range of only −10 to 80° C. by the use of three kinds of currently used lubricating oils having different viscosities can be stably operated in the temperature range of −30 to 80° C. over a long period of time by the use of only one kind of the lubricating oil composition.

When the second lubricating oil composition of the invention is used for a movable portion of a watch, duration of the watch is greatly extended from 10 years (duration of currently used watch) to 20 years. On this account, watches requiring maintenance at intervals of 10 years, such as sunlight power-generation watch (trade name: Ecodrive, available from Citizen Watch Co., Ltd.), thermal power-generation watch (trade name: Ecothermo, available from Citizen Watch Co., Ltd.) and wristwatch guaranteed throughout the lifetime, can be operated over 20 years with high reliability, and hence they can be made maintenance-free. In addition, by virtue of no corrosion of watch members or no viscosity increase of the lubricating oil composition, the battery life is extended, and as a result, the number of watches withdrawn to a service station because of operation failure is markedly decreased.

The third lubricating oil composition of the invention comprises the ether oil (G) as a base oil, a specific amount of the anti-wear agent (C) comprising a neutral phosphoric ester and/or a neutral phosphorous ester and the antioxidant (E), so that this composition is free from change of properties over a long period of time and is favorable as a watch lubricating oil.

Especially when the third lubricating oil composition of the invention which comprises the ether oil (G), 0.1 to 8% by weight of a neutral phosphoric ester and/or a neutral phosphorous ester as the anti-wear agent (C) and the antioxidant (E) and which has a total acid number of not more than 0.2 mgKOH/g is used as a watch lubricating oil, corrosion of watch members or viscosity increase of the lubricating oil composition can be inhibited, and hence duration of the watch is greatly extended from 10 years (duration of currently used watch) to 20 years. On this account, watches requiring maintenance at intervals of 10 years, such as sunlight power-generation watch (trade name: Ecodrive, available from Citizen Watch Co., Ltd.), thermal power-generation watch (trade name: Ecothermo, available from Citizen Watch Co., Ltd.) and wristwatch guaranteed throughout the lifetime, can be operated over 20 years with high reliability, and hence they can be made maintenance-free. In addition, by virtue of no corrosion of watch members or no viscosity increase of the lubricating oil composition, the battery life is extended, and as a result, the number of watches withdrawn to a service station because of operation failure is markedly decreased.

EXAMPLE

A. Example Relating to the First Lubricating Oil Composition of the Invention and Watch using the Composition Watch Movements™ (No. 2035, available from Citizen Watch Co., Ltd., train wheel portions: made of metal (mainly made of brass and iron)) were fabricated using, as watch lubricating oils, an ester oil (polyol ester base oil represented by the formula $(C_4H_9)_3CCH_2OCH_2C(C_4H_9)_3$), a paraffinic hydrocarbon oil (PAO) (1-pentene tetramer hydride base oil), a silicone oil (dimethyl polysiloxane base oil) and a currently used oil (aforesaid Synt-Lube, lubricating oil composition, available from MOEBIUS Co.). The consumption electric currents of the thus fabricated watches were measured before and after operation at ordinary temperature for 1000 hours, and the measured values were compared.

As a result, in the use of the ester oil, PAO and the currently used oil, no difference in the consumption electric current was observed after the operation. On the other hand, in the use of the silicone oil, increase of the consumption electric current was observed. Increase of the consumption electric current means shortening of the battery life, so that the silicone oil was found to be unsuitable as a watch lubricating oil. The results are set forth in Table 1.

TABLE 1

| | Consumption electric current (μA) | | | | |
|---|---|---|---|---|---|
| Oil Type | Initial value | After operation | Change | Acceptance criterion | Judgement |
| Ester Oil | 0.97 | 0.97 | 0.00 | 0.20 | AA |
| PAO | 0.97 | 0.97 | 0.00 | 0.20 | AA |
| Silicone oil | 0.98 | 1.32 | 0.34 | 0.20 | BB |
| Currently used oil | 0.97 | 0.97 | 0.00 | 0.20 | AA |

Next, an experiment to compare evaporation loss of the ester oil with that of PAO and thereby determine which was superior as the base oil was carried out in the following manner.

An ester oil (polyol ester base oil, represented by the formula $C(—CH_2—O—CO—C_4H_9)_4$) having a kinematic viscosity of not more than 1500 cSt at −30° C. and PAO (1-hexene trimer hydride base oil represented by the formula $H(—CH_2—CH(C_4H_9)—)_3H$) having a kinematic viscosity of not more than 1500 cSt at −30° C. were prepared. To each of them, a methacrylate compound (polymethacrylate having a kinematic viscosity of 1550 cSt at 100° C.) and an olefin compound (ethylene/α-olefin copolymer having a kinematic viscosity of 2000 cSt at 100° C.) were added as viscosity index improvers in such amounts that the resulting composition would have a kinematic viscosity of not more than 1500 cSt at −30° C. and not less than 15 cSt at 80° C. Thus, lubricating oil compositions each having a kinematic viscosity of desired range were prepared Then, using the lubricating oil compositions and a currently used oil, Watch Movements™ (No. 2035, available from Citizen Watch Co., Ltd., train wheel portions: made of metal (mainly made of brass and iron)) were fabricated, and they were continuously operated at 70° C. and 0.5 atm. for 1000 hours to measure consumption electric currents before and after the operation.

As a result, in case of the lubricating oil compositions using the ester oil and the currently used oil, change of the consumption electric current was not observed after the test. On the other hand, in case of the lubricating oil composition using PAO, marked increase of the consumption electric current was observed after the test. Then, a change of the amount of the lubricating oil composition fed was observed. As a result, in case of the lubricating oil composition using the ester oil, almost the same amount of the lubricating oil composition as that initially fed remained, and viscosity change was not observed On the other hand, in case of the lubricating oil composition using PAO, evaporation and viscosity increase were observed.

Further, the lubricating oil composition using the ester oil, the lubricating oil composition using PAO and the currently used oil were allowed to stand at 90° C., and their weight changes were measured. As a result, the currently used oil was found to have a weight loss of 1.62% by weight, the lubricating oil composition using the ester oil was found to have a weight loss of 0.75% by weight, and the lubricating oil composition using PAO was found to have a weight loss of 8.35% by weight. From the above results, it has been confirmed that high-temperature operation stability can be obtained if the evaporation loss is not more than 1.62% by weight at 90° C. The evaporation loss of the lubricating oil composition using PAO was large, so that this lubricating oil composition was found to be unsuitable as a watch lubricating oil. The results are set forth in Table 2.

TABLE 2

| | Consumption electric current (μA) | | | Evaporation | | |
|---|---|---|---|---|---|---|
| Oil type | Initial value | After operation | Change | loss (wt %) | Viscosity change | Judgment |
| Ester oil | 0.97 | 0.99 | 0.02 | 0.75 | none | AA |
| PAO | 1.00 | 1.57 | 0.57 | 8.35 | increase | BB |
| Currently used oil | 0.98 | 0.99 | 0.01 | 1.62 | none | AA |

Next, an experiment to select an ester oil having a structure most suitable for a watch was carried out in the following manner.

Using the following ester oils, Watch Movements™ (No. 2035, available from Citizen Watch Co., Ltd., train wheel portions: made of metal (mainly made of brass and iron)) were fabricated.

As diesters (adipic diesters), dioctyl adipate, dioctyl sebacate, diisodecyl adipate, didecyl adipate and a dimer acid dioctyl ester (kinematic viscosity measured at 100° C.: 270 cSt) were used. As polyol esters, a neopentyl glycol caprylate caprate mixed ester (kinematic viscosity measured at 100° C.: 2.5 cSt), a trimethylolpropane valerate heptanoate mixed ester (kinematic viscosity measured at 100° C.: 3.0 cSt), a trimethylolpropane decanoate octanoate mixed ester (kinematic viscosity measured at 100° C.: 4.3 cSt), trimethylolpropane nananoate and a pentaerythritol heptanoate caprate mixed ester (kinematic viscosity measured at 100° C.: 5.0 cSt) were used.

The resulting watches were continuously operated at 70° C. for 1000 hours at a rate of 64 times to measure consumption electric currents before and after the operation.

As a result, in any case of the polyol esters, change of the consumption electric current was not observed after the operation and the watches operated well. On the other hand, in case of the diesters, increase of the consumption electric current was observed after the operation. From the above results, it has been confirmed that the polyol ester oil is excellent as a watch lubricating oil. The results are set forth in Table 3.

TABLE 3

| Type | Compound | Consumption electric current (μA) | Judgment |
|---|---|---|---|
| Diester | Dioctyl adipate | +0.35 | BB |
| | Dioctyl sebacate | +0.28 | BB |
| | Diisodecyl adipate | +0.30 | BB |
| | Didecyl adipate | +0.23 | BB |
| | Dimer acid dioctyl ester | +0.25 | BB |
| Polyol ester | Neopentyl glycol caprylate caprate mixed ester | +0.10 | AA |
| | Trimethylolpropane valerate heptanoate mixed ester | +0.05 | AA |
| | Trimethylolpropane decanoate octanoate mixed ester | +0.04 | AA |
| | Trimethylolpropane nonanoate | +0.05 | AA |
| | Pentaerythritol heptanoate caprate mixed ester | +0.06 | AA |

Next, an experiment to determine the optimum amount of the viscosity index improver was carried out in the following manner.

To a trimethylolpropane valerate heptanoate mixed ester (kinematic viscosity measured at 100° C.: 2.5 cSt) as a polyol ester having a kinematic viscosity of less than 1500 cSt at −30° C., polyacrylate (neutralization value: 0.1, kinematic viscosity measured at 100° C.: 850 cSt), polymethacrylate (neutralization value: 0.1, kinematic viscosity measured at 100° C.: 850 cSt), polyisobutylene (kinematic viscosity measured at 100° C.: 1000 cSt), polyalkylstyrene (polyethylstyrene, kinematic viscosity measured at 100° C.: 600 cSt), polyester (polyethylene fumarate, kinematic viscosity measured at 100° C.: 500 cSt), isobutylene fumarate (kinematic viscosity measured at 100° C.: 1000 cSt), styrene maleate ester (kinematic viscosity measured at 100° C.: 3000 cSt) or vinyl acetate fumarate ester (kinematic viscosity measured at 100° C.: 1800 cSt) was added as a viscosity index improver in amounts of 0% by weight, 0.1% by weight, 5% by weight, 10% by weight, 20% by weight, 25% by weight and 30% by weight. Thus, lubricating oil compositions were prepared.

Then, the kinematic viscosities of the lubricating oil and the lubricating oil compositions were measured to judge whether the kinematic viscosity measured at −30° C. was not more than 1500 cSt and whether the kinematic viscosity measured at 80° C. was not less than 13 cSt. Further, using the lubricating oil and the lubricating oil compositions, watches were fabricated, and operation of the watches was observed.

As a result, when each viscosity index improver was added in an amount of 0.1 to 20% by weight, the kinematic viscosity of the above-mentioned desired range could be obtained. From the observation of the operation of the watches, it was found that the watches using the lubricating oil compositions each containing 0.1 to 20% by weight of the viscosity index improver operated properly, but the lubricating oil containing 0% by weight of the viscosity index improver ran down at 80° C. and the watches could not operate well. When the amount of the viscosity index improver was 25% by weight or 30% by weight, the lubricating oil compositions could not be fed at ordinary temperature in the fabrication of the watch because of too high viscosity. From the above results, it has been confirmed that it is preferable to add the viscosity index improver in an amount of 0.1 to 20% by weight. The results are set forth in Table 4.

TABLE 4

| Viscosity index improver | Amount to obtain proper viscosity | Evaluation of watch operation |
|---|---|---|
| | | 0 wt %<br>0.1~20 wt %<br>25 wt % or more |
| Polyacrylate | 0.1~20 wt % | Failure at 80° C.<br>good operation<br>non-producible |
| Polymethacrylate | 0.1~20 wt % | Failure at 80° C.<br>good operation<br>non-producible |
| Polyisobutylene | 0.1~20 wt % | Failure at 80° C.<br>good operation<br>non-producible |
| Polyalkylstyrene | 0.1~20 wt % | Failure at 80° C.<br>good operation<br>non-producible |
| Polyeser | 0.1~20 wt % | Failure at 80° C.<br>good operation<br>non-producible |
| Isobutylene fumarate | 0.1~20 wt % | Failure at 80° C.<br>good operation<br>non-producible |
| Styrene maleate ester | 0.1~20 wt % | Failure at 80° C.<br>good operation<br>non-producible |
| Vinyl acetate fumarate ester | 0.1~20 wt % | Failure at 80° C.<br>good operation<br>non-producible |

Next, an experiment to find a suitable anti-wear agent and the amount thereof was carried out in the following manner.

To a trimethylolpropane valerate heptanoate mixed ester (kinematic viscosity measured at 100° C.: 3.0 cSt) as a polyol ester having a kinematic viscosity of less than 1500 cSt at −300C, 0.1 to 20% by weight of polymethyl methacrylate (kinematic viscosity measured at 100° C.: 1550 cSt, neutralization value: 0.1) was added as a viscosity index improver. Thus, a lubricating oil composition having a kinematic viscosity of not more than 1500 cSt at −30° C. and not less than 13 cSt at 80° C. was prepared.

Then, to the composition, a metal type anti-wear agent (zinc diethyl dithiophosphate (ZnCTP) selected from metal type anti-wear agents such as ZnDTP and molybdenum diethyl dithiophosphate (MoDTP)), a sulfide type anti-wear agent (distearyl sulfide that is an alkyl sulfide), a neutral phosphoric ester type anti-wear agent (tricresyl phosphate selected from neutral phosphoric ester type anti-wear agents such as tricresyl phosphate and trixylenyl phosphate), an acid phosphoric ester type anti-wear agent (lauryl acid phosphate), a neutral phosphorous ester type anti-wear agent (trioleyl phosphite), an acid phosphorous ester type anti-wear agent (dilauryl hydrogenphosphite) or an acid phosphoric ester amine salt (lauryl acid phosphate diethylamine salt) was added as an anti-wear agent in an amount of 0 to 10 % by weight. Thus, lubricating oil compositions were prepared.

Then, using the lubricating oil compositions, Watch Movements™ (No. 2035, available from Citizen Watch Co., Ltd., train wheel portions: made of metal (mainly made of brass and iron)) were fabricated, and operation of the watches was observed.

As a result, in the watches using the lubricating oil compositions each containing the metal type anti-wear agent, the sulfide type anti-wear agent, the acid phosphorous ester type anti-wear agent or the acid phosphoric ester amine salt anti-wear agent, corrosion and gelation took place, and operation failure occurred. In the watch using the lubricating oil composition containing the acid phosphoric ester type anti-wear agent, corrosion and gelation took place at high temperatures, and operation failure occurred. The watches using the lubricating oil compositions each containing the neutral phosphoric ester type anti-wear agent or the neutral phosphorous ester type anti-wear agent in an amount of more than 0% by weight and not more than 8% by weight were free from frictional wear and operated well. In case of addition of 0% by weight, however, wear took place and the watch stopped. When the neutral phosphoric ester type anti-wear agent or the neutral phosphorous ester type anti-wear agent was added in an amount of more than 8% by weight, any change in the frictional wear tendency was not observed in comparison with the case of addition of 8% by weight. From the above results, it has been confirmed that it is preferable to add as an anti-wear agent the neutral phosphoric ester or the neutral phosphorous ester in an amount of 0.1 to 8% by weight. The results are set forth in Table 5.

TABLE 5

| Anti-wear agent | Evaluation of watch | Optimum amount | Judgment |
|---|---|---|---|
| Metal type | Occurrence of operation failure | — | BB |
| Sulfide type | Occurrence of operation failure | — | BB |
| Neutral phosphoric ester type | 0 wt %: occurrence of operation failure | — | BB |
| | 0.1~8 wt %: good operation | AA | AA |
| | More than 8 wt %: equal wear resistance | — | — |
| Acid phosphoric ester type | Occurrence of operation failure | — | BB |
| Neutral phosphorous ester type | 0 wt %: occurrence of operation failure | — | BB |
| | 0.1~8 wt %: good operation | AA | AA |
| | More than 8 wt %: equal wear resistance | — | — |
| Acid phosphorous ester type | Occurrence of operation failure | — | BB |
| Acid phosphoric ester amine salt | Occurrence of operation failure | — | BB |

Next, an experiment to find an available range of the total acid number of the lubricating oil composition was carried out in the following manner.

To each of a neopentyl glycol caprylate caprate mixed ester (kinematic viscosity measured at 100° C.: 2.5 cSt), a trimethylolpropane valerate heptanoate mixed ester (kinematic viscosity measured at 100° C.: 3.0 cSt), a trimethylolpropane decanoate octanoate mixed ester (kinematic viscosity measured at 100° C.: 4.3 cSt), trimethylolpropane nananoate and a pentaerythritol heptanoate caprate mixed ester (kinematic viscosity measured at 100° C.: 5.0 cSt) which were classified into polyol esters, valeric acid was added in such an amount that the resulting composition would have total acid numbers of 0.2, 0.5, 1.0 or 1.2 mgKOH/g. Thus, lubricating oil compositions were prepared.

Then, using the lubricating oil compositions, Watch Movements™ (No. 2035, available from Citizen Watch Co., Ltd., train wheel portions: made of metal (mainly made of brass and iron)) were fabricated, and they were continuously operated at 60° C. and a humidity of 95% for 1000 hours at a rate of 64 times to measure consumption electric currents before and after the operation.

As a result, in any case of the lubricating oil compositions each having a total acid number of not less than 0.5 mgKOH/g, increase of the consumption electric current was observed, and corrosion of watch members and viscosity increase were also observed. On the other hand, in case of she total acid number of 0.2 mgKOH/g, neither change of the consumption electric current, viscosity increase nor corrosion of the members was observed.

From the above results, it has been confirmed that the polyol ester-containing lubricating oil composition having a total acid number of not more than 0.2 mgKOH/g is suitable as a watch lubricating oil. The results are set forth in Table 6.

TABLE 6

| Lubricating oil composition Type of base oil | Total acid number (mgKOH/g) Change of consumption electric current (μA) Judgment | | | |
|---|---|---|---|---|
| Neopentyl glycol caprylate caprate mixed ester | 0.2 | 0.5 | 1.0 | 1.2 |
| | +0.05 | −0.26 | +0.27 | +0.35 |
| | AA | BB | BB | BB |
| Trimethylolpropane valerate heptanoate mixed ester | 0.2 | 0.5 | 1.0 | 1.2 |
| | +0.02 | +0.25 | +0.25 | +0.32 |
| | AA | BB | BB | BB |
| Trimethylolpropane decanoate octanoate mixed ester | 0.2 | 0.5 | 1.0 | 1.2 |
| | +0.10 | +0.27 | +0.27 | +0.31 |
| | AA | BB | BB | BB |
| Trimethylolpropane nonanoate | 0.2 | 0.5 | 1.0 | 1.2 |
| | +0.12 | +0.25 | +0.27 | +0.33 |
| | AA | BB | BB | BB |
| Pentaerythritol heptanoate caprate mixed ester | 0.2 | 0.5 | 1.0 | 1.2 |
| | +0.08 | +0.26 | +0.28 | +0.30 |
| | AA | BB | BB | BB |

Next, comparison in performance between a currently used oil (aforesaid Synt-Lube available from MOEBIUS Co.) and the first lubricating oil composition of the invention was made in the following manner using an electronic watch made of metal.

To a polyol ester having a kinematic viscosity of not more than 1500 cSt at −30° C. (neopentyl glycol caprylate caprate mixed ester (kinematic viscosity measured at 100° C.: 2.5 cSt) or trimethylolpropane valerate heptanoate mixed ester (kinematic viscosity measured at 100° C.: 3.0 cSt)), 0.1 to 20% by weight of a viscosity index improver (aforesaid polyacrylate, polymethacrylate, polyisobutylene, polyalkylstyrene, polyester, isobutylene fumarate, styrene maleate ester or vinyl acetate fumarate ester), 0.1 to 8% by weight of an anti-wear agent (neutral phosphoric ester (trioleyl phosphate) or neutral phosphorous ester (trixylenyl phosphite)), 0.5% by weight of an antioxidant (phenol type antioxidant (2,6-di-t-butyl-p-cresol) or amine type antioxidant (diphenylamine derivative, trade name: Irganox L57, available from Ciba Specialty Chemicals Co.)) and 0.05% by weight of a metal deactivator (benzotriazole) were added. Thus, lubricating oil compositions each having a kinematic viscosity of not more than 1500 cSt at −30° C. and not less than 13 cSt at 80° C., a weight change of not more than 1.62% by weight after allowed to stand at 90° C. and a total acid number of not more than 0.2 mgKOH/g were prepared as watch lubricating oils.

Then, using the lubricating oil compositions and a currently used oil (aforesaid Synt-Lube available from MOEBIUS Co., total acid number: 1.24 mgKOH/g), Watch Movements™ (No. 2035, available from Citizen Watch Co., Ltd., train wheel portion: made of metal (mainly made of brass and iron)) were fabricated, and they were continuously operated under the conditions of −30° C., −10° C., ordinary temperature, 80° C., or 45° C. and a humidity of 95%, for 1000 hours to measure consumption electric currents before and after the operation. Further, train wheels endurance test of hand rotations corresponding to 20 years was carried out at ordinary temperature at a rate of 64 times using 20 samples.

As a result, in any case of the currently used oil compositions using the polyol ester oil as a base oil, increase of the consumption electric current was rarely observed, and the watches operated properly.

In case of the currently used oil (lubricating oil composition), the watch operated properly at −10° C. and ordinary temperature but stopped at −30° C. At 80° C., the lubricating oil composition ran down and the consumption electric current value increased. In case of a temperature of 45° C. and a humidity of 95%, corrosion and viscosity increase attributable to the lubricating oil composition were observed, and increase of the consumption electric current value occurred. In the train wheels endurance test corresponding to 20 years, the watch operated properly for the time corresponding to 10 years, but the watch stopped at the time corresponding to 20 years.

Next, comparison in performance between a currently used oil (aforesaid Synt-Lube available from MOEBIUS Co., lubricating oil composition) and the first lubricating oil composition of the invention was made in the following manner using a mechanical watch and a watch having a plastic part in the train wheel portions.

To a polyol ester having a kinematic viscosity of not more than 1500 cSt at −30° C. (neopentyl glycol caprylate caprate mixed ester (kinematic viscosity measured at 100° C.: 2.5 cSt) or trimethylolpropane valerate heptanoate mixed ester (kinematic viscosity measured at 100° C.: 3.0 cSt)), 0.1 to 20% by weight of a viscosity index improver (aforesaid polyacrylate, polymethacrylate, polyisobutylene, polyalkylstyrene, polyester, isobutylene fumarate, styrene maleate ester or vinyl acetate fumarate ester), 0.1 to 8% by weight of an anti-wear agent (neutral phosphoric ester (triphenyl phosphate) or neutral phosphorous ester (tristearyl phosphate)), 0.5% by weight of an antioxidant (phenol type antioxidant (2,6-di-t-butyl-4-methylphenol) or amine type antioxidant (diphenylamine derivative, trade name: Irganox L06, available from Ciba Specialty Chemicals Co.)) and 0.05% by weight of a metal deactivator (benzotriazole) were added. Thus, lubricating oil compositions each having a kinematic viscosity of not more than 1500 cSt at −30° C. and not less than 13 cSt at 80° C., a weight change of not more than 1.62% by weight after allowed to stand at 90° C. and a total acid number of not more than 0.2 mgKOH/g were prepared as watch lubricating oils.

Then, using the lubricating oil compositions, Watch Movements™ using a plastic part (No. 7680, No. 1030, available from Citizen Watch Co., Ltd., train wheel portion: plastic gear is used) and Watch Movements™ (mechanical watches, No. 6650, No. 8200) were fabricated, and they were continuously operated under the conditions of −30° C., −10° C., ordinary temperature, 80° C., or 45° C. and a humidity of 95%, for 1000 hours to measure consumption electric currents before and after the operation. Further, train wheels endurance test corresponding to 20 years was carried out at ordinary temperature at a rate of 64 times using 20 samples.

As a result, in any test, change of the consumption electric current value was not observed, and the watches operated properly.

B. Example Relating to the Second Lubricating Oil Composition of the Invention and Watch using the Composition Watch Movements™ (available from Citizen Watch Co., Ltd., train wheel portions: made of plastic) were fabricated using an ester oil (dihexyl succinate), a paraffinic hydrocarbon oil (PAO) (tetramer of 1-decene), a silicone oil (dimethyl polysiloxane) and a currently used oil (aforesaid Synt-Lube, available from MOEBIUS Co.). The consumption electric currents of the thus fabricated watches were measured before and after operation at ordinary temperature for 1000 hours, and the measured values were compared.

As a result, in the use of PAO and the currently used oil, no difference in the consumption electric current was observed after the operation. On the other hand, in the use of the ester oil and the silicone oil, increase of the consumption electric current was observed. Increase of the consumption electric current means shortening of the battery life, so that the ester oil and the silicone oil were each found to be unsuitable as a plastic watch lubricating oil. The results are set forth in Table 7.

TABLE 7

| | Consumption electric current (μA) | | | | |
|---|---|---|---|---|---|
| Oil type | Initial value | After operation | Change | Acceptance criterion | Judgment |
| Ester oil | 0.97 | 1.25 | 0.28 | 0.20 | BB |
| PAO | 0.97 | 0.97 | 0.00 | 0.20 | AA |
| Silicone oil | 0.98 | 1.32 | 0.34 | 0.20 | BB |
| Currently used oil | 0.97 | 0.97 | 0.00 | 0.20 | AA |

Next, an experiment to compare evaporation losses of various PAO and thereby determine the number of carbon atoms of PAO preferably employable as the base oil was carried out in the following manner.

To each of PAO having a kinematic viscosity of 2 cSt at 100° C. (referred to as "PAO2"), PAO having a kinematic viscosity of 3 cSt at 100° C. (referred to as "PAO3"), PAO having a kinematic viscosity of 4 cSt at 100° C. (referred to as "PAO4") and PAO having a kinematic viscosity of 5 cSt at 100° C. (referred to as "PAO5"), a methacrylate compound (polymethyl methacrylate (kinematic viscosity measured at 100° C.: 1550 cSt), trade name: Aclube 707, available from Sanyo Kasei K.K.) and an olefin compound (ethylene/α-olefin copolymer (kinematic viscosity measured at 100° C.: 2000 cSt), trade name: Lucant HC2000, available from Mitsui Chemicals, Inc.) were added as viscosity index improvers in such amounts that the resulting composition would have a kinematic viscosity of not more than 1500 cSt at −30° C. and not less than 15 cSt at 80° C. Thus, lubricating oil compositions having desired kinematic viscosity were prepared.

Then, using the lubricating oil compositions and a currently used oil (aforesaid Synt-Lube, available from MOEBIUS Co.), Watch Movements™ (available from Citizen Watch Co., Ltd., train wheel portions: made of plastic) were fabricated, and they were continuously operated at 70° C. and 0.5 atm. for 1000 hours to measure consumption electric currents before and after the operation.

As a result, in the case of the lubricating oil composition using PAO4, the lubricating oil composition using PAO5 and the conventional oil, change of the consumption of electric current was not observed after the test: On the other hand, in the case of the lubricating oil composition using PAO2 and the lubricating oil composition using PAO3, marked increase of the consumption of electric current was observed after the test. Then, a change in the amount of the lubricating oil composition fed was observed. As a result, in the case of the lubricating oil composition using PAO4 and the lubricating oil composition using PAO5, almost the same amount of the lubricating oil composition as that initially fed remained, and viscosity change was not observed. On the other hand, in the case of the lubricating oil composition using PAO2 and the lubricating oil composition using PAO3, evaporation and viscosity increase were observed.

Further, weight changes of the lubricating oil compositions using PAO and the currently used oil after they were allowed to stand at 90° C. were measured. As a result, the currently used oil was found to have a weight loss of 1.62% by weight, the lubricating oil composition using PAO2 was found to have a weight loss of 13.6% by weight, the lubricating oil composition using PAO3 was found to have a weight loss of 8.35% by weight, the lubricating oil composition using PAO4 was found to have a weight loss of 0.70% by weight, and the lubricating oil composition using PAO5 was found to have a weight loss of 0.30% by weight. From the above results, it has been confirmed that high-temperature operation stability can be obtained if the evaporation loss is not more than 1.62% by weight at 90° C.

As for the PAO used in this example, the number of carbon atoms increased in order of PAO2 to PAO5. The number of carbon atoms of PAO4 was 30, so that the number of carbon atoms of PAO suitable as a base oil of a watch lubricating oil proved to be not less than 30. The results are set forth in Table 8.

TABLE 8

| | Consumption electric current (μA) | | | Evaporation | | |
|---|---|---|---|---|---|---|
| Oil Type | Initial value | After operation | change | loss (wt %) | Viscosity change | Judgment |
| PAO2 | 0.97 | 1.59 | 0.62 | 15.6 | increase | BB |
| PAO3 | 0.97 | 1.47 | 0.50 | 8.35 | increase | BB |
| PAO4 | 0.98 | 1.00 | 0.02 | 0.70 | none | AA |
| PAO5 | 0.97 | 1.01 | 0.03 | 0.30 | none | AA |
| Currently used oil | 0.98 | 0.99 | 0.01 | 1.62 | none | AA |

Next, an experiment to determine the optimum amount of the viscosity index improver was carried out in the following manner.

To a paraffinic hydrocarbon oil (PAO5) having less than 30 carbon atoms and a kinematic viscosity of 1500 cSt at −30° C., polyacrylate (polymethyl acrylate, kinematic viscosity measured at 100° C.: 850 cSt, neutralization value: 0.1), polymethacrylate (polymethyl methacrylate, kinematic viscosity measured at 100° C.: 1550 cSt, neutralization value: 0.1), polyisobutylene (kinematic viscosity measured at 100° C.: 1000 cSt), polyalkylstyrene (polyethylstyrene, kinematic viscosity measured at 100° C.: 600 cSt), polyester (polyethylene fumarate, kinematic viscosity measured at 100° C.: 500 cSt), isobutylene fumarate (kinematic viscosity measured at 100° C.: 1000 cSt), styrene maleate ester (kinematic viscosity measured at 100° C.: 3000 cSt) or vinyl acetate fumarate ester (kinematic viscosity measured at 100° C.: 1800 cSt) was added as a viscosity index improver in amounts of 0% by weight, 0.1% by weight, 5% by weight, 10% by weight, 15% by weight, 20% by weight and 30% by weight. Thus, lubricating oil compositions were prepared.

Then, kinematic viscosities of the lubricating oil and the lubricating oil compositions were measured to judge whether the kinematic viscosity measured at −30° C. was not more than 1500 cSt and whether the kinematic viscosity measured at 80° C. was not less than 13 cSt. Further, using the lubricating oil and the lubricating oil compositions, watches were fabricated, and operation of the watches was observed.

As a result, when each viscosity index improver was added in an amount of 0.1 to 15% by weight, the desired kinematic viscosity could be obtained. From the observation of operation of the watches, it was found that the watches using the lubricating oil compositions each containing 0.1 to 15% by weight of the viscosity index improver operated properly, but the lubricating oil containing 0% by weight of the viscosity index improver ran down at 80° C. and the watches could not operate well. When the amount of the viscosity index improver was 20% by weight, the lubricating oil compositions could not be fed at ordinary temperature in the fabrication of the watch because of too high viscosity. When the amount of the viscosity index improver was 30% by weight, the viscosity index improver could not be dissolved in the base oil. From the above results, it has been confirmed that it is preferable to add the viscosity index improver in an amount of 0.1 to 15%.

Next, to a paraffinic hydrocarbon oil (PAO5) having 30 or more carbon atoms and a kinematic viscosity of less than 1500 cSt at −30° C., a viscosity index improver (ethylene/α-olefin copolymer, kinematic viscosity measured at 100° C.: 2000 cSt) was added in an amount of 0.1 to 15% by weight. Thus, a lubricating oil composition having a kinematic viscosity of not more than 1500 cSt at −30° C. and not less than 13 cSt at 80° C. was prepared.

Then, using the lubricating oil composition, Watch Movement™ (available from Citizen Watch Co., Ltd., train wheel portions: made of plastic) was fabricated, and operation of the watch was observed. As a result, the watch operated well.

From the above results, it has been confirmed that by the use of a lubricating oil composition having been controlled to have a kinematic viscosity of not more than 1500 cSt at −30° C. and not less than 13 cSt at 80° C. by adding 0.1 to 15% by weight of a viscosity index improver to a paraffinic hydrocarbon oil (PAO) having 30 or more carbon atoms and having small evaporation loss, a watch having a plastic movable portion can be operated well.

There are watches having a movable portion made of plastic and metal and watches having a movable portion made of metal only, so that it is necessary to add an anti-wear agent or a metal deactivator.

Next, an experiment to find a suitable anti-wear agent and the amount thereof was carried out in the following manner.

To a paraffinic hydrocarbon oil (PAO4) having 30 or more carbon atoms and a kinematic viscosity of less than 1500 cSt at −30° C., a viscosity index improver (ethylene/α-olefin copolymer, kinematic viscosity measured at 100° C.: 1000 cSt) was added in an amount of 0.1 to 15% by weight. Thus, a lubricating oil composition having a kinematic viscosity of not more than 1500 cSt at −30° C. and not less than 13 cSt at 80° C. was prepared.

Then, to the lubricating oil composition, a metal type anti-wear agent (ZnDTP selected from metal type anti-wear agents such as ZnDTP and MoDTP), a sulfide type anti-wear agent (distearyl sulfide that is an alkyl sulfide), a neutral phosphoric ester type anti-wear agent (tricresyl phosphate selected from neutral phosphoric ester type anti-wear agents such as tricresyl phosphate and trixylenyl phosphate), an acid phosphoric ester type anti-wear agent (lauryl acid phosphate), a neutral phosphorous ester type anti-wear agent (trioleyl phosphite), an acid phosphorous ester type anti-wear agent (dilauryl hydrogenphosphite) or an acid phosphoric ester amine salt (lauryl acid phosphate diethylamine salt) was added as an anti-wear agent in an amount of 0 to 10% by weight with varying the amount. Thus, lubricating oil compositions were prepared.

Then, using the lubricating oil compositions, Watch Movements™ (No. 2035, available from Citizen Watch Co., Ltd., train wheel portions: made of metal (mainly made of brass and iron)) were fabricated, and operation of the watches was observed.

As a result, in the watches using the lubricating oil compositions each containing the metal type anti-wear agent, the sulfide type anti-wear agent, the acid phosphorous ester type anti-wear agent or the acid phosphoric ester amine salt anti-wear agent, corrosion and gelation took place, and operation failure occurred. In the watch using the lubricating oil composition containing the acid phosphoric ester type anti-wear agent, corrosion and gelation took place at high temperatures, and operation failure occurred. The watches using the lubricating oil compositions each containing the neutral phosphoric ester type anti-wear agent or the neutral phosphorous ester type anti-wear agent in an amount of more than 0% by weight and not more than 8% by weight were free from frictional wear and operated well. In case of addition of 0% by weight, however, wear took place and the watch stopped. When the neutral phosphoric ester type anti-wear agent or the neutral phosphorous ester type anti-wear agent was added in an amount of more than 8% by weight, any change in the frictional wear tendency was not observed in comparison with the case of addition of 8% by weight. From the above results, it has been confirmed that it is preferable to add as an anti-wear agent the neutral phosphoric ester or the neutral phosphorous ester in an amount of 0.1 to 8% by weight. The results are set forth in Table 9.

TABLE 9

| Anti-wear agent | Evaluation of Watch | Optimum amount | Judgment |
|---|---|---|---|
| Metal type | Occurrence of operation failure | — | BB |
| Sulfide type | Occurrence of operation failure | — | BB |
| Neutral phosphoric ester type | 0 wt %: occurrence of operation failure | — | BB |
| | 0.1~8 wt %: good operation | AA | AA |
| | More than 8 wt %: equal wear resistance | — | — |
| Acid phosphoric ester type | Occurrence of operation failure | — | BB |
| Neutral phosphorous ester type | 0 wt %: occurrence of operation failure | — | BB |
| | 0.1~8 wt %: good operation | AA | AA |
| | more than 8 wt %: equal wear resistance | — | — |
| Acid phosphorous ester type | Occurrence of operation failure | — | BB |
| Acid phosphoric ester amine salt | Occurrence of operation failure | — | BB |

Next, an experiment to find an available range of the total acid number of the lubricating oil composition was carried out in the following manner.

To each of a paraffinic hydrocarbon oil (PAO) having 30 carbon atoms and a kinematic viscosity of less than 1500 cSt at −30° C. (PAO4, trade name: PAO401, available from Chevron Co.) and a paraffinic hydrocarbon oil (PAO) having more than 30 carbon atoms and a kinematic viscosity of less than 1500 cSt at −30° C. (PAO5, trade name: PAO501, available from Chevron Co.), viscosity index improvers (ethylene/α-olefin copolymers, trade name: Lucant HC2000, available from Mitsui Chemicals, Inc., trade name: Lucant HC100, available from Mitsui Chemicals, Inc.) were added in amounts of 0.1 to 15% by weight. Thus, lubricating oil compositions each having a kinematic viscosity of not more than 1500 cSt at −30° C. and not less than 13 cSt at 80° C. were prepared.

Then, to each of the lubricating oil compositions, valeric acid was added in such an amount that the resulting composition would have a total acid number of 0.2, 0.5, 1.0 or 1.2 mgKOH/g. Thus, lubricating oil compositions were prepared.

Then, using the lubricating oil compositions, Watch Movements™ (No. 2035, available from Citizen Watch Co., Ltd., train wheel portion: made of metal (mainly made of brass and iron)) were fabricated, and they were continuously operated at 60° C. and a humidity of 95% for 1000 hours at a rate of 64 times to measure consumption electric currents before and after the operation.

As a result, in any case of the lubricating oil compositions each having a total acid number of not less than 0.5 mgKOH/g, increase of the consumption electric current was observed, and corrosion of watch members and viscosity increase were also observed. On the other hand, in case of the total acid number of 0.2 mgKOH/g, neither change of the consumption electric current, viscosity increase nor corrosion of the members was observed.

From the above results, it has been confirmed that the paraffinic hydrocarbon oil-containing lubricating oil composition having a total acid number of not more than 0.2 mgKOH/g is suitable as a watch lubricating oil. The results are set forth in Table 10.

TABLE 10

| Lubricating oil composition Base oil | Total acid number (mgKOH/g) Change of consumption of electric current (μA) Judgment | | | |
|---|---|---|---|---|
| PAO4 | 0.2 | 0.5 | 1.0 | 1.2 |
| | +0.03 | +0.26 | +0.23 | +0.34 |
| | AA | BB | BB | BB |
| PAO5 | 0.2 | 0.5 | 1.0 | 1.2 |
| | +0.04 | +0.29 | +0.29 | +0.33 |
| | AA | BB | BB | BB |

Next, comparison in performance between a currently used oil (aforesaid Synt-Lube available from MOEBIUS Co.) and the second lubricating oil composition of the invention was made in the following manner using an electronic watch made of metal.

To a paraffinic hydrocarbon oil (number of carbon atoms: 30 or more, trade name PAO501, available from Chevron Co.) having a kinematic viscosity of not more than 1500 cSt at −30° C., 0.1 to 15% by weight of a viscosity index improver (aforesaid polyacrylate, polymethacrylate, polyisobutylene, polyalkylstyrene, polyester, isobutylene fumarate, styrene maleate ester or vinyl acetate fumarate ester), 0.1 to 8% by weight of an anti-wear agent (neutral phosphoric ester (trioctyl phosphate) or neutral phosphorous ester (trioleyl phosphite)), 0.5% by weight of an antioxidant (phenol type antioxidant (2,6-di-t-butyl-p-cresol) or amine type antioxidant (diphenylamine derivative, trade name: Irganox L57, available from Ciba Specialty Chemicals Co.)) and 0.05% by weight of a metal deactivator (benzotriazole) were added. Thus, lubricating oil compositions each having a kinematic viscosity of not more than 1500 cSt at −30° C. and not less than 13 cSt at 80° C., a weight change of not more than 10% by weight after allowed to stand at 90° C. and a total acid number of not more than 0.2 mgKOH/g were prepared as watch lubricating oils.

Then, using the lubricating oil compositions and a currently used oil (aforesaid Synt-Lube available from MOEBRIS Co., total acid number: 1.24 mgKOH/g), Watch Movements™ (No. 2035, available from Citizen Watch Co., Ltd., train wheel portion: made of metal (mainly made of brass and iron)) were fabricated, and they were continuously operated under the conditions of −30° C., −10° C., ordinary temperature, 80° C., or 45° C. and a humidity of 95%, for 1000 hours to measure consumption of electric currents before and after the operation. Further, train wheels endurance test corresponding to 20 years was carried out at ordinary temperature at a rate of 64 times using 20 samples.

As a result, in any test of the lubricating oil compositions each using the paraffinic hydrocarbon oil as a base oil, increase of the consumption of electric current was rarely observed, and the watches operated properly.

In the case of the currently used oil, the watch operated properly at −10° C. and ordinary temperature but stopped at −30° C. At 80° C., the currently used lubricating oil composition ran down and the consumption of electric current value increased. In the case of a temperature of 45° C. and a humidity of 95%, corrosion and viscosity increase attributable to the lubricating oil composition were observed, and increase of the consumption of electric current value occurred. In the durability test corresponding to 20 years, the watch operated properly for the time corresponding to 10 years, but the watch stopped at the time corresponding to 20 years.

Next, comparison in performance between a currently used oil (aforesaid Synt-Lube available from MOEBIUS Co.) and the second lubricating oil composition of the invention was made in the following manner using a mechanical watch and a watch having train wheel portions consisting of metal parts and plastic parts.

To a paraffinic hydrocarbon oil (number of carbon atoms: 30 or more, trade name PAO501, available from Chevron Co.) having a kinematic viscosity of not more than 1500 cSt at −30° C., 0.1 to 15% by weight of a viscosity index improver (aforesaid polyacrylate, polymethacrylate, polyisobutylene, polyalkylstyrene, polyester, isobutylene fumarate, styrene maleate ester or vinyl acetate fumarate ester), 0.1 to 8% by weight of an anti-wear agent (neutral phosphoric ester (trioctyl phosphate) or neutral phosphorous ester (trioleyl phosphite)), 0.5% by weight of an antioxidant (phenol type antioxidant (2,6-di-t-butyl-p-cresol) or amine type antioxidant (diphenylamine derivative, trade name: Irganox L06, available from Ciba Specialty Chemicals Co.)) and 0.05% by weight of a metal deactivator (benzotriazole) were added. Thus, lubricating oil compositions each having a kinematic viscosity of not more than 1500 cSt at −30° C. and not less than 13 cSt at 80° C., a weight change of not more than 10% by weight (1.62% by weight) after allowed to stand at 90° C. and a total acid number of not more than 0.2 mgKOH/g were prepared as watch lubricating oils.

Then, using the lubricating oil compositions, Watch Movements™ using metal parts and plastic parts (No. 7680, No. 1030, available from Citizen Watch Co., Ltd., train wheel portions: plastic and metal gears are used) and Watch Movements™ (mechanical watches, No. 6650, No. 8200) were fabricated, and they were continuously operated under the conditions of −30° C., −10° C., ordinary temperature, 80° C., or 45° C. and a humidity of 95%, for 1000 hours to measure consumption of electric currents before and after the operation. Further, train wheels endurance test corresponding to 20 years was carried out at ordinary temperature at a rate of 64 times using 20 samples.

As a result, in any test, change of the consumption of electric current value was not observed, and the watches operated properly.

C. Example Relating to the Third Lubricating Oil Composition of the Invention and Watch Using the Composition An experiment to find a suitable type of the anti-wear agent and the amount thereof was carried out in the following manner.

To an ether oil (alkyl-substituted diphenyl ether, trade name: Morescohighlube LB32, available from Matsumura Oil Research Corp.) as a base oil, a metal type anti-wear agent (ZnDTP selected from metal type anti-wear agents such as ZnDTP and MoDTP), a sulfide type anti-wear agent (distearyl sulfide that is an alkyl sulfide), a neutral phosphoric ester type anti-wear agent (tricresyl phosphate selected from neutral phosphoric ester type anti-wear agents such as tricresyl phosphate and trixylenyl phosphate), an acid phosphoric ester type anti-wear agent (lauryl acid phosphate), a neutral phosphorous ester type anti-wear agent (trioleyl phosphite), an acid phosphorous ester type anti-wear agent (dilauryl hydrogenphosphite) or an acid phosphoric ester amine salt (lauryl acid phosphate diethylamine salt) was added as an anti-wear agent in an amount of 0 to 10%. Thus, lubricating oil compositions were prepared as watch lubricating oils.

Then, using the lubricating oil compositions, Watch Movements™ (No. 2035, available from Citizen Watch Co., Ltd., train wheel portions: made of metal (mainly made of brass and iron)) were fabricated, and operation of the watches was observed.

As a result, in the watches using the lubricating oil compositions each containing the metal type anti-wear agent, the sulfide type anti-wear agent, the acid phosphorous ester type anti-wear agent or the acid phosphoric ester amine salt anti-wear agent, corrosion and gelation took place, and operation failure occurred. In the watch using the lubricating oil composition containing the acid phosphoric ester type anti-wear agent, corrosion and gelation took place at high temperatures, and operation failure occurred. The watches using the lubricating oil compositions each containing the neutral phosphoric ester type anti-wear agent or the neutral phosphorous ester type anti-wear agent in an amount of more than 0% by weight and not more than 8% by weight were free from frictional wear and operated well. In case of addition of 0% by weight, however, wear took place and the watch stopped. When the neutral phosphoric ester type anti-wear agent or the neutral phosphorous ester type anti-wear agent was added in an amount of more than 8% by weight, any change in the frictional wear tendency was not observed in comparison with the case of addition of 8% by weight. From the above results, it has been confirmed that it is preferable to add as an anti-wear agent the neutral phosphoric ester or the neutral phosphorous ester in an amount of 0.1 to 8% by weight. The results are set forth in Table 11.

TABLE 11

| Anti-wear agent | Evaluation of watch | Optimum amount | Judgment |
|---|---|---|---|
| Metal type | Occurrence of operation failure | — | BB |
| Sulfide type | Occurrence if operation | — | BB |

TABLE 11-continued

| Anti-wear agent | Evaluation of watch | Optimum amount | Judgment |
|---|---|---|---|
| | failure | | |
| Neutral | 0 wt %: occurrence of operation failure | — | BB |
| phosphoric ester type | 0.1~8 wt %: good operation | AA | AA |
| | more than 8 wt %: equal wear resistance | — | — |
| Acid phosphoric ester type | Occurrence of operation failure | — | BB |
| Neutral phosphorous ester type | 0 wt %: occurrence of operation failure | — | BB |
| | 0.1~8 wt %: good operation | AA | AA |
| | more than 8 wt %: equal wear resistance | — | — |
| Acid phosphorous ester type | Occurrence of operation failure | — | BB |
| Acid phosphoric ester amine salt | Occurrence of operation failure | — | BB |

Next, an experiment to find an available range of the total acid number of the lubricating oil composition was carried out in the following manner.

An ether oil (Morescohighlube LB22 (trade name), available from Matsumura Oil Research Corp.) as base oils, an anti-wear agent (trioctyl phosphate) and an antioxidant (2,6-di-t-butyl-p-cresol) were added. Then, lauric acid was added in such an amount that the resulting composition would have a total acid number of 0.2, 0.5, 1.0 or 1.2 mgKOH/g. Thus, lubricating oil compositions were prepared.

Then, using the lubricating oil compositions, Watch Movements™ (No. 2035, available from Citizen Watch Co., Ltd., train wheel portion: made of metal (mainly made of brass and iron)) were fabricated, and they were continuously operated at 60° C. and a humidity of 95% for 1000 hours at a rate of 64 times to measure consumption of electric currents before and after the operation.

As a result, in any case of the lubricating oil compositions each having a total acid number of not less than 0.5 mgKOH/g, increase of the consumption of electric current was observed, and corrosion of watch members and viscosity increase were also observed. On the other hand, in the case of the total acid number of 0.2 mgKOH/g, neither change of the consumption of electric current, viscosity increase nor corrosion of the From the above results, it has beer confirmed that the ether oil-containing lubricating oil composition having a total acid number of not more than 0.2 mgKOH/g is suitable as a watch lubricating oil. The results are set forth in Table 12.

TABLE 12

| Total acid number (mgKOH/g) | 0.2 | 0.5 | 1.0 | 1.2 |
|---|---|---|---|---|
| Change of consumption electric current (μA) | +0.02 | +0.29 | +0.27 | +0.35 |
| Judgment | AA | BB | BB | BB |

Next, comparison in performance between a currently used oil (aforesaid Synt-Lube available from MOEBIUS Co.) and the third lubricating oil composition of the invention was made in the following manner using an electronic watch made of metal.

To an ether oil (trade name: Morescohighlube LB15, available from Matsumura Oil Research Corp.) as a base oil, 0.1 to 8% by weight of an anti-wear agent (neutral phosphoric ester (trioctyl phosphate) or neutral phosphorous ester (trioleyl phosphite)) and an antioxidant (2,6-di-t-butyl-p-cresol) were added. Thus, lubricating oil compositions each having a total acid number of not more than 0.2 mgKOH/g were prepared as watch lubricating oils.

Then, using the lubricating oil compositions and a currently used oil (total acid number: 1.24 mgKOH/g), Watch Movements™ (No. 2035, available from Citizen Watch Co., Ltd., train wheel portions: made of metal (mainly made of brass and iron)) were fabricated, and they were continuously operated under the conditions of −10° C., ordinary temperature, 60° C., or 45° C. and a humidity of 95%, for 1000 hours to measure consumption of electric currents before and after the operation. Further, train wheels endurance test corresponding to 20 years was carried out at ordinary temperature at a rate of 64 times using 20 samples.

As a result, in any test of the third lubricating oil compositions using the ether as a base oil, change of the consumption of electric current value was rarely observed, and the watches operated properly. In the case of the currently used oil, the watch operated properly at −10° C., ordinary temperature and 60° C., but in the case of a temperature of 45° C. and a humidity of 95%, corrosion and viscosity increase attributable to the currently used lubricating oil composition were observed, and increase of the consumption of electric current value occurred. In the train wheels endurance test corresponding to 20 years, the watch operated properly for the time corresponding to 10 years, but the watch stopped at the time corresponding to 20 years.

Next, comparison in the performance between the third lubricating oil compositions of the invention was made in the following manner using a mechanical watch and a watch having train wheel portions consisting of metal parts and plastic parts.

To an ether oil (trade name: Morescohighlube LB32, available from Matsumura Oil Research Corp.) as a base oil, 0.1 to 8% by weight of an anti-wear agent (neutral phosphoric ester (trioctyl phosphate) or neutral phosphorous ester (trioleyl phosphite)) and an antioxidant (2,6-di-t-butyl-p-cresol) were added. Thus, lubricating oil compositions each having a total acid number of not more than 0.2 mgKOH/g were prepared as watch lubricating oils.

Then, using the lubricating oil compositions, Watch Movements™ using metal parts and plastic parts (No. 7680, No. 1030, available from Citizen Watch Co., Ltd., train wheel portions: plastic and metal gears are used) and Watch Movements™ (mechanical watches, No. 6650, No. 8200) were fabricated, and they were continuously operated under the conditions of −30° C., −10° C., ordinary temperature, 80° C., or 45° C. and a humidity of 95%, for 1000 hours to measure consumption electric currents before and after the operation. Further, the train wheels endurance test corresponding to 20 years was carried out at ordinary temperature at a rate of 64 times using 20 samples.

As a result, in any test, change of the consumption of electric current value was not observed, and the watches operated properly.

What is claimed is:

1. A watch having a movable portion lubricated with a lubricating oil composition comprising a base oil comprising a polyol ester (A), a viscosity index improver (B) in an amount of 0.1 to 20% by weight and an anti-wear agent (C) in an amount of 0.1 to 8% by weight, said oil composition having a kinematic viscosity of not more than 1500 cSt and not less than 13 cSt at −30 to 80° C., a weight change of not more than 1.62% by weight after allowed to stand for 1000 hours at 90° C. and a total acid number of not more than 0.2 mgKOH/g, wherein:

the polyol ester (A) has a kinematic viscosity at −30° C. of not more than 1500 cSt, and the anti-wear agent (C) is a neutral phosphoric ester and/or a neutral phosphorous ester.

2. A watch having a movable portion lubricated with a lubricating oil composition as claimed in claim 1, wherein the polyol ester (A) is a polyol ester having no hydroxyl group at the molecular end.

3. A watch having a movable portion lubricated with a lubricating oil composition as claimed in claim 1, wherein the viscosity index improver (B) is at least one compound selected from polyacrylate, polymethacrylate, polyisobutylene, polyalkylstyrene, polyester, isobutylene fumarate, styrene maleate ester, vinyl acetate fumarate ester and an α-olefin copolymer.

4. A watch having a movable portion lubricated with a lubricating oil composition as claimed in claim 1, said lubricant further comprising a metal deactivator (D).

5. A watch having a movable portion lubricated with a lubricating oil composition as claimed in claim 4, wherein the metal deactivator (D) is benzotriazole or a derivative thereof.

6. A watch having a movable portion lubricated with a lubricating oil composition as claimed in claim 4, said lubricant further comprising an antioxidant (E).

7. A watch having a movable portion lubricated with a lubricating oil composition as claimed in claim 1, said lubricant further comprising an antioxidant (E).

8. A watch having a movable portion lubricated with a lubricating oil composition as claimed in claim 7, wherein the antioxidant (E) is a phenol type antioxidant and/or an amine type antioxidant.

9. A watch having a movable portion lubricated with a lubricating oil composition as claimed in claim 8, wherein the amine type antioxidant is a diphenylamine derivative.

10. A watch having a movable portion lubricated with a lubricating oil composition as claimed in claim 8, wherein the phenol type antioxidant is 2,6-di-t-butyl-p-cresol, 2,4,6-tri-t-butylphenol or 4,4'-methylenebis (2,6-di-t-butyl) phenol.

11. A watch having a movable portion lubricated with a lubricating oil composition comprising a base oil comprising a paraffinic hydrocarbon oil (F) consisting essentially of an α-olefin polymer having at least 30 carbon atoms, and a viscosity index improver (B) in an amount of 0.1 to 15% by weight and an anti-wear agent (C) in an amount of 0.1 to 8% by weight, said oil composition having a total acid number of not more than 0.2 mgKOH/g, wherein:

the anti-wear agent (C) is a neutral phosphoric ester and/or a neutral phosphorous ester.

12. A watch having a movable portion lubricated with a lubricating oil composition as claimed in claim 11, wherein said lubricant has a kinematic viscosity of not more than 1500 cSt and not less than 13 cSt at −30 to 80° C.

13. A watch having a movable portion lubricated with a lubricating oil composition as claimed in claim 11, wherein said lubricant has a kinematic viscosity of not more than 1500 cSt and not less than 13 cSt at −30 to 80° C. and a weight change of not more than 10% by weight after allowed to stand for 1000 hours at 90° C.

14. A watch having a movable portion lubricated with a lubricating oil composition as claimed in claim 11, wherein the viscosity index improver (B) is at least one compound selected from polyacrylate, polymethacrylate, polyisobutylene, polyalkyistyrene, polyester, isobutylene fumarate, styrene maleate ester, vinyl acetate fumarate ester and an α-olefin copolymer.

15. A watch having a movable portion lubricated with a lubricating oil composition as claimed in claim 11, said lubricant further comprising a metal deactivator (D).

16. A watch having a movable portion lubricated with a lubricating oil composition as claimed in claim 15, wherein the metal deactivator (D) is benzotriazole or a derivative thereof.

17. A watch having a movable portion lubricated with a lubricating oil composition as claimed in claim 15, said lubricant further comprising an antioxidant (E).

18. A watch having a movable portion lubricated with a lubricating oil composition as claimed in claim 11, said lubricant further comprising an antioxidant (E).

19. A watch having a movable portion lubricated with a lubricating oil composition as claimed in claim 18, wherein the antioxidant (E) is a phenol type antioxidant and/or an amine type antioxidant.

20. A watch having a movable portion lubricated with a lubricating oil composition comprising a base oil comprising an ether oil (G), an anti-wear agent (C) and an antioxidant (E), wherein the anti-wear agent (C) is a neutral phosphoric ester and/or a neutral phosphorous ester and the content of the anti-wear agent (C) is in the range of 0.1 to 8% by weight, said oil composition having a total acid number of not more than 0.2 mgKOH/g.

21. A watch having a movable portion lubricated with a lubricating oil composition as claimed in claim 20, wherein the ether oil (G) is an ether oil represented by the following formula:

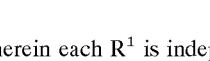

$$R^1—(—O—R^2—)_n—R^1$$

wherein each $R^1$ is independently an alkyl group of 1 to 18 carbon atoms or a monovalent aromatic hydrocarbon group of 6 to 18 carbon atoms, $R^2$ is an alkylene group of 1 to 18 carbon atoms or a divalent aromatic hydrocarbon group of 6 to 18 carbon atoms, and n is an integer of 1 to 5.

22. A watch having a movable portion lubricated with a lubricating oil composition as claimed in claim 20, wherein the antioxidant (E) is a phenol type antioxidant and/or an amine type antioxidant.

* * * * *

UNITED STATES PATENT AND TRADEMARK OFFICE

CERTIFICATE OF CORRECTION

PATENT NO. : 6,858,567 B2
DATED : February 22, 2005
INVENTOR(S) : Yuji Akao

It is certified that error appears in the above-identified patent and that said Letters Patent is hereby corrected as shown below:

Column 29,
Line 48, "of the" should read -- of the members was observed. --.

Signed and Sealed this

Thirteenth Day of September, 2005

JON W. DUDAS
*Director of the United States Patent and Trademark Office*